US005938130A

United States Patent [19]

Zickell

[11] Patent Number: 5,938,130

[45] Date of Patent: Aug. 17, 1999

[54] ASPHALT MATERIAL RECYCLING SYSTEM AND METHOD

[76] Inventor: Thomas J. Zickell, 107 Tidewater Farms Rd., Stratham, N.H. 03885

[21] Appl. No.: 09/104,085

[22] Filed: Jun. 24, 1998

Related U.S. Application Data

[63] Continuation-in-part of application No. 08/756,881, Dec. 2, 1996, Pat. No. 5,848,755.

[51] Int. Cl.[6] ..... B02C 19/12

[52] U.S. Cl. ..... 241/65; 241/153; 241/171

[58] Field of Search ..... 241/65, 153, 171, 241/23, 31, 66, 67, 80, 97, 177, DIG. 38, 54, 19, 184

[56] References Cited

U.S. PATENT DOCUMENTS 4,009,992 3/1977 Eicke .
4,300,292 11/1981 Vadas et al. .
4,504,149 3/1985 Mendehall .
4,706,893 11/1987 Brock .
5,219,450 6/1993 Thurk .
5,229,095 7/1993 Schimmel et al. .
5,294,061 3/1994 van Dijk .
5,385,426 1/1995 Omann .

*Primary Examiner*—Mark Rosenbaum

[57] ABSTRACT

An asphalt based material recycling system and method is used to recycle asphalt materials, such as asphalt shingles and tar paper that include granules, fibers or other particles. The asphalt material is simultaneously heated and milled in a heated milling apparatus, such as a heated ball mill, to reduce the asphalt material including granules to a fine mesh in suspension in liquid asphalt. Excess moisture is removed from the asphalt material being recycled by continuously venting the heated milling apparatus. The heated milling apparatus preferably includes a rotatable milling vessel rotated at an acute angle with respect to the horizontal plane and having an opening that provides continuous venting. The shape of the milling vessel allows the liquid level inside the milling vessel to have a liquid head above the outlet region of the milling vessel, for facilitating milling. The rotatable milling vessel includes a plurality of mixing members, such as rods or paddles, extending from an interior surface to enhance milling and to pull the asphalt material being recycled under and into the liquid slurry. The asphalt material recycling system further includes a filter apparatus for filtering reduced asphalt and removing foreign objects therefrom.

12 Claims, 8 Drawing Sheets

ASPHALT MATERIAL RECYCLING SYSTEM AND METHOD

RELATED APPLICATION

This application is a continuation-in-part of U.S. patent application Ser. No. 08/756,881 filed Dec. 2, 1996 now U.S. Pat. No. 5,848,755.

FIELD OF THE INVENTION

This invention relates to a recycling system and method and in particular, to a system and method of recycling asphalt based material.

BACKGROUND OF THE INVENTION

Considerable waste is involved with the manufacture, use and discontinued use of asphalt based products such as roofing materials, including roofing shingles and rolled roofing membranes. For example, each new roofing shingle manufactures has cutout tabs that are removed and discarded. Old shingle materials removed from old buildings also add to a significant amount of roofing material waste. Indeed, it is estimated that approximately $400 million dollars are spent annually in the US alone on dumping fees for old asphalt based roofing products. Further, these old roofing materials are then buried in a landfill presenting a permanent environmental problem.

Waste generated from both new and used roofing materials such as asphalt shingles presents a significant environmental concern because of the composition of the roofing material. Typical shingles are composed of a paper or mat saturated with asphalt, an asphalt coating on the paper or mat, and granules disposed on the coating. Such materials have typically required complex recycling processes. Used roofing materials are recyclable because during the aging process, the asphalt oxidizes and merely looses its pliability. All that is needed to re-use and recycle this used asphalt is to add virgin, non-oxidized asphalt, such as flux or aromatic rich asphalt, or other material such has solvents or oil, to "re-juvenate" the old oxidized asphalt.

Past attempts at recycling asphalt shingles have failed for many reasons. For example, the prior art recycling systems have failed to reduce the shingle granules to a size small enough for the recycled shingle material to be reused in a standard roofing material manufacturing plant. If the granules in the recycled shingle material are not reduced to a fine granulation (less than approximately 50 mesh), the granules will not remain suspended in an asphalt solution cannot be pumped, and/or the recycled shingle material cannot be reused in roofing or other products which use asphalt which is pumped to the manufacturing site from a storage container, unless constant high speed agitation of the solution is provided.

Some past methods of recycling asphalt roofing material have used milling machines, such as rolling mills, bag mills, hammer mills, saw mills, etc. to produce a recycled roofing material which can be used only in road construction or as other similar "filler" material. However, merely milling the shingle material in a reduction mill without further processing has been unsuccessful in reducing the granules in the shingle material to a fine mesh so that the recycled asphalt can be reused in roofing products.

Further, such prior art systems fail to allow large and irregularly shaped pieces of used roofing material to enter the mill, while also accounting for the handling and discharge of unwanted debris such as nails, rocks and sticks.

One such apparatus for recycling roofing shingles is disclosed in U.S. Pat. No. 4,706,893 to Brock. This apparatus includes a hammer mill that comminutes the shingles and a vessel that subsequently dries then mixes the recycled shingle material with a liquid asphalt for recycling as an asphalt paving composition. This milling process will not reduce the granules in the shingle material to a small enough size for the shingle material to be reused in applications other than an asphalt paving composition. This apparatus also must be cooled and wetted to keep the shingles from sticking to the hammers.

Another shingle reducing apparatus is disclosed in U.S. Pat. No. 5,385,426 to Omann. This complex apparatus includes a shredder, two hammer mills, and two heated vessels for drying the shingle material after it has been reduced. This apparatus further requires spraying the shingles with water prior to entering the first hammer mill. This extremely complex and involved process requiring two hammer mills also is not capable of completely reducing the granules in the recycled shingle material to a fine mesh or powder. Moreover, removing the water that is introduced is expensive since the water must be boiled off before use.

One reason milling machines have been unsuccessful in reducing the granules in the recycled shingle material is because the shingle material was not heated as it was milled. In the past, heating the milling machine as the shingle material is milled was considered hazardous because of pressure build-up in the closed milling vessel or heating vessel as a result of moisture in the shingle material. Heating would also make hammer mills gum up and not work because the asphalt would become sticky and not flow out of the mill absent the introduction of liquefied asphalt or other liquid product to allow the finished milled product to flow out of the mill.

SUMMARY OF THE INVENTION

Accordingly, the present invention provides an asphalt material recycling apparatus and method that is capable of recycling both new and used asphalt based materials such as roofing shingles, rolled roofing material, and other similar asphalt based materials, while in the process reducing granules, cellulose fibers, fiberglass fibers and other particles in the asphalt based material to a fine mesh that can be maintained in suspension under normal agitation conditions in liquid asphalt for later reuse. Such an apparatus and method for recycling asphalt based materials and in particular, asphalt based roofing materials is capable of handling large irregularly shaped pieces of material while simultaneously milling and heating the asphalt based material without any danger of pressure build up and subsequent explosion.

Simultaneously heating and milling is also more economical because the BTU's from the milling process are captured and used in the processing of the recycled product into a roofing product since the temperature of the recycled product is close to the required processing temperature. The apparatus and method is also relatively simple so as to maximize production and efficiency and to avoid clogging of the recycled shingled material during the recycling process.

The present invention features an asphalt material recycling system and method for recycling an asphalt based material, such as granular asphalt roofing material. The method comprises simultaneously heating and milling the asphalt material in a heated milling apparatus, for removing excess moisture from the asphalt material and for reducing the asphalt material.

According to the preferred method, the step of removing moisture is performed simultaneously with the heating and milling of the asphalt based material, by providing a large opening to the heated milling vessel which allows large irregular pieces to be entered into the milling vessel and which also continuously vents the heated milling apparatus during heating and milling. The heating and milling in the heated milling apparatus preferably includes rotating a milling vessel containing a plurality of milling elements and the asphalt material at an acute angle with respect to the horizontal plane, and heating the milling vessel with a heat source while rotating the milling vessel.

The method further includes inserting asphalt based material into an opening of the milling vessel to an interior milling region, and forcing the asphalt material in the interior region and away from the opening in the milling vessel. The roofing material and asphalt are preferably fed into the milling vessel while it is rotating, speeding up the recycle time significantly. The heat in the asphalt drives off the moisture preventing foaming in the mill.

In the preferred embodiment, virgin, non-oxidized asphalt, aromatic rich asphalt, flux asphalt, solvents, oil, or a combination of any of these is added to the recycled mixture to "rejuvenate" the mixture of recycled asphalt.

Another method of recycling asphalt material further includes drying the asphalt material in a drying apparatus, for removing moisture from the asphalt material, prior to heating and milling the asphalt material. This method further includes the step of transferring the dried asphalt material to the heated milling apparatus.

The recycling method may also include passing the asphalt based material which has been processed in a first heated and rotating milling vessel to a second processing unit which is preferably, but not limited to, a second heated rotating milling vessel similar to the first heated milling vessel.

In one embodiment, the second heated rotating milling vessel includes a second heated ball mill, for further reducing the size of the recycled asphalt based material to a fine mesh suitable for re-use in roofing shingles and other roofing materials.

The recycling method may further include storing the reduced asphalt material in a storage apparatus. Storing the reduced asphalt material preferably includes rotating the reduced asphalt material in a storage drum at an acute angle with respect to the horizontal plane, and heating the storage drum.

The storage apparatus preferably includes a rotatable storage drum having an opening and an interior storage region, for receiving reduced asphalt material. A storage drum rotation mechanism may be coupled to the rotatable storage drum, for rotating the rotatable storage drum and the reduce asphalt in the interior storage region. A storage heat source is disposed proximate the rotatable storage drum, for heating the rotatable storage drum while rotating and storing the reduced asphalt material. The storage apparatus further includes a plurality of mixing members such as fins, rods, bars, etc., mounted to at least an interior side surface of the rotatable storage drum, for allowing the recycled stored asphalt based material to be mixed when the drum is rotated in one direction and allowing the material to be conveyed out of the opening when rotated in the other direction without pumping the material.

The recycling method further includes filtering the reduced asphalt material either after the first or second processing stages or both, for removing foreign objects in the reduced asphalt material. Filtering reduced asphalt material preferably includes passing the reduced asphalt material through one or more filtering apparatus and preventing foreign objects from passing through the filtering apparatus.

The filtering apparatus preferably includes a first filter coupled to the first rotating milling vessel, for filtering the recycled asphalt material output from the first rotating milling vessel. The first filter is preferably a rotary filter.

The filtering apparatus also preferably includes a second filter comprising a filter housing having an inlet, for receiving reduced asphalt material, and an outlet, for discharging filtered, reduced asphalt material. One or more filter cartridges are disposed in the filter housing. Each filter cartridge has a plurality of apertures, for allowing reduced asphalt to pass through and for preventing foreign objects from passing through the filter cartridge. The filter apparatus may further include a filter heat source, for heating the filter housing and the reduced asphalt material during filtering.

The asphalt material recycling system of the present invention includes a heated milling apparatus including a rotatable milling vessel having a large opening which remains open at all times during the recycling process, for both venting purposes and for providing an opening by which to introduce large and irregularly shaped material to be recycled into the heated milling apparatus. The heated milling apparatus also includes an interior milling region for receiving the asphalt material to be recycled.

A milling vessel rotation mechanism is coupled to the milling vessel, for rotating the milling vessel and asphalt material in the interior milling region. A plurality of milling elements, such as balls, are disposed within the rotatable milling vessel, for milling the asphalt material as the rotatable milling vessel rotates. A milling vessel heat source is disposed proximate the rotatable milling vessel, for heating the rotatable milling vessel as the milling vessel rotates and the asphalt material is milled. The axis of rotation of the milling vessel is preferably disposed at an acute angle with respect to the horizontal plane such that the milling vessel is rotated at the acute angle.

The heated milling apparatus preferably includes a plurality of mixing members mounted to an interior surface of the rotatable milling vessel, for moving and mixing the asphalt material with the milling elements and for "pulling" the asphalt based material being recycled down into the asphalt slurry and into the milling elements, causing the asphalt based material to be recycled to be milled. The mixing members preferably include circular rods, solid or hollow square members, angle iron, or other similar mixing members mounted to the interior surface of at least the sides of the rotatable milling vessel and extending into the interior milling region. The surface of the back or discharge side of the rotatable milling vessel also preferably includes mixing members which serve to mix as well as discharge the recycled asphalt based material from the rotating milling vessel.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
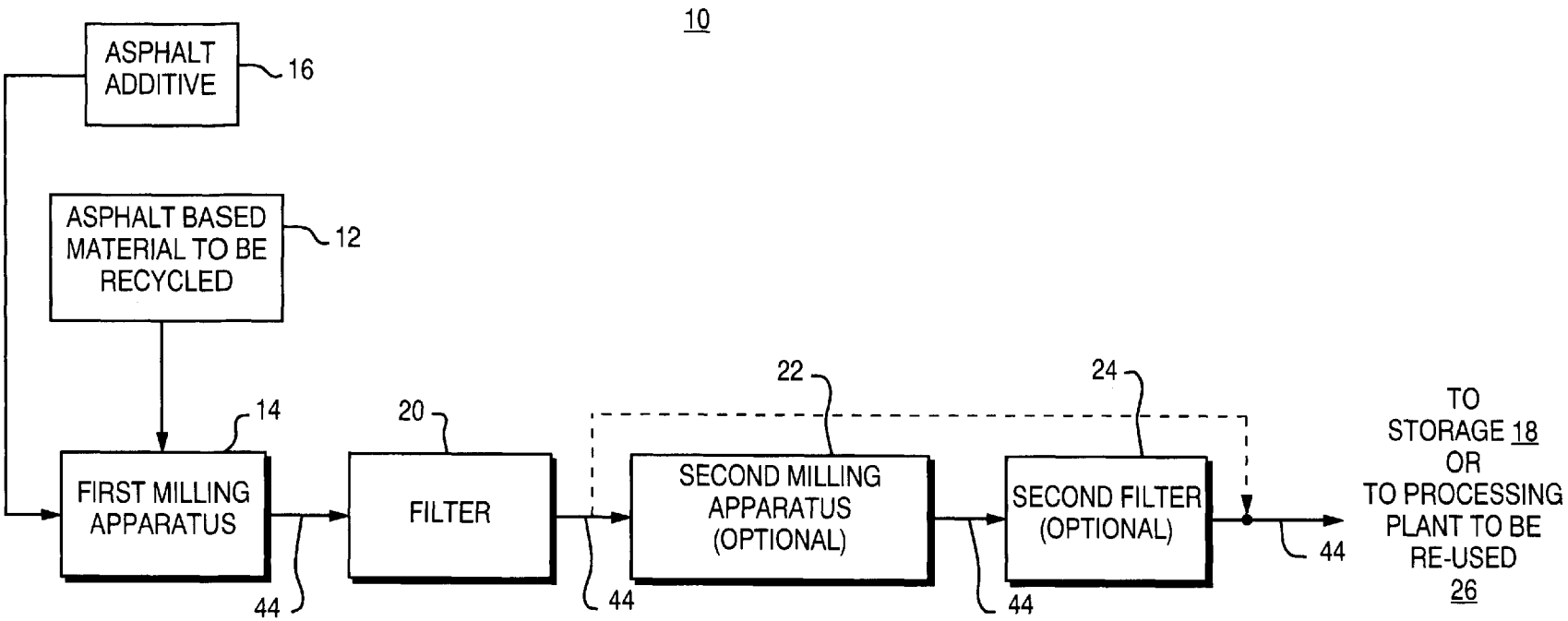
FIG. 1 is a schematic block diagram of an asphalt material recycling system according to the present invention.
Figure 2:
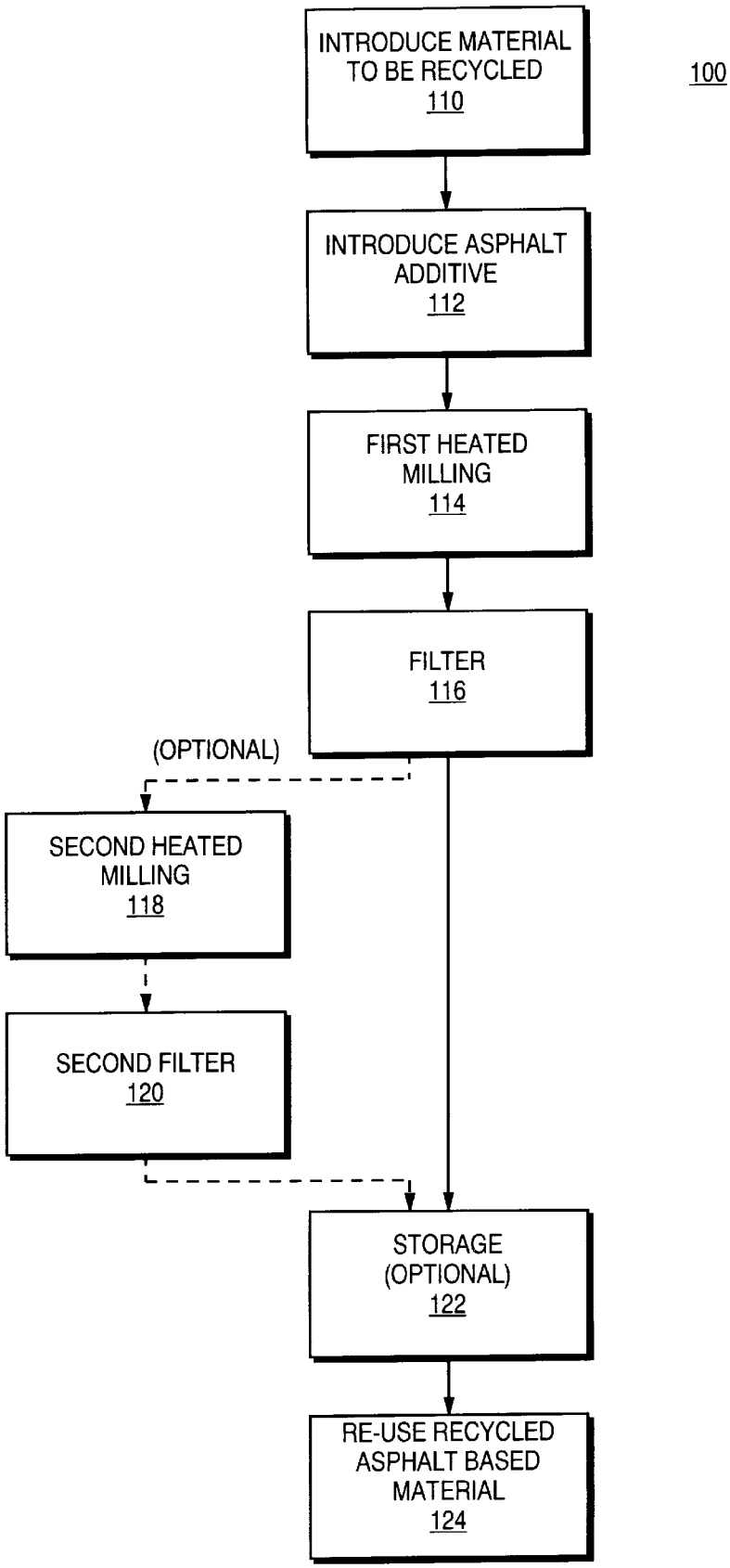
FIG. 2 is a flow chart of the method for asphalt material recycling according o the present invention.

An asphalt based material recycling system 10, FIG. 1, and method 100, FIG. 2, according to the present invention, is used to recycle asphalt material 12, such as asphalt (organic and/or fiberglass based) roof shingles (e.g. scrap shingles or new roofing material manufacturing waste), tar paper, roll roofing, built up roofing, and other similar granular or non-granular coated asphalt based materials.

The asphalt based material as well as granules, fibers and/or other particles are reduced to a fine mesh and suspended in a liquefied recycled asphalt based product that can be stored and/or reused in the manufacture of asphalt based products such as asphalt based roofing products, asphalt paving compositions, roof cements and other applications.

Although the recycling system and method is described herein as an asphalt material recycling system and method, the present invention contemplates using the same system and method to recycle other types of asphaltic compositions, such as asphalt paving and asphalt built up roofing.

According to the asphalt material recycling method of the present invention, excess moisture and other built up gases are removed from the asphalt material to be recycled 12 after the material to be recycled is introduced into the milling vessel, step 110, and as the asphalt material 12 is simultaneously heated and milled, step 114, in at least a first stage milling apparatus 14.

The asphalt material 12 is preferably heated to a temperature in the range of about 200° to 450° F. and most preferably at between at least 220° to about 350° F. The simultaneous heating and milling is preferably performed until the granules or particles in the asphalt material are reduced into smaller sized particles, preferably passing through approximately 200 mesh. By varying the heating and various milling vessel parameters (as will be described below) of the asphalt material, the asphalt based material to be recycled can be reduced to any desired granule size.

The reduced granules or particles form a slurry together with the asphalt. During the milling process, a processing additive 16 such as virgin (flux) asphalt in liquid form, resins, solvents, oils, plastics (recycled, such as plastic bottles and bottle caps), plastic films, or similar materials which can withstand the processing temperatures without boiling and vaporizing can be added to the heated milling apparatus 14 and/or to the recycled asphalt material after the milling apparatus step 112, to further liquefy or otherwise improve the desired characteristics of the asphalt based material being recycled, to maintain a proper liquefied consistency (viscosity) allowing the recycled asphalt material to be poured, pumped or otherwise dispensed from the heated milling apparatus 12, and to provided the required characteristics of the recycled material such as melt point,.

The removal of excess moisture or gases from asphalt material, either prior to heating and milling or more preferably during heating and milling, allows for the simultaneous heating and milling of the asphalt material without a dangerous pressure build up and possible explosion in the heated milling apparatus 12 due to water vapor and steam, and avoids having to use expensive pressure vessels as the milling apparatus 12. In the one system that has been constructed in accordance with the present invention, a cement delivery truck shaped vessel has proved very satisfactory for use as a milling vessel.

According to the preferred embodiment, any remaining moisture after the asphalt mixing stage is removed from the asphalt material simultaneously with the heating and milling of the asphalt material by continuously venting the heated milling apparatus 12, as will be described in greater detail below. According to another embodiment, the asphalt material may be first dried in a drying apparatus such as a rotary kiln. The drying apparatus removes a significant amount of the moisture or gases from the asphalt material prior to heating and milling of the asphalt material in the heated milling apparatus as will be described in greater detail below.

One embodiment of the asphalt material recycling system and method 10, 100, also includes a storage apparatus 18 step 122 that receives and stores reduced asphalt material from at least the first heated milling apparatus 14. The storage apparatus 18 preferably generally continuously mixes and heats the reduced asphalt material during storage, as is well know in the art.

In a second and preferred embodiment, the recycled and "rejuvenated" asphalt based material is utilized by introducing the mixture into the manufacturing phase of a processing plant 26, for the manufacture of a new asphalt based material or product step 124.

One embodiment of the asphalt material recycling system 10 includes at least a first filter apparatus 20 that receives reduced asphalt material from the heated milling apparatus 12. The filter apparatus 18 filters the reduced asphalt material to remove larger pieces or asphalt based material to be recycled as well as foreign objects, such as nails, metal scraps, or other debris that has not been reduced to a smaller size particle step 116. The filter apparatus 18 allows the reduced asphalt material to pass through while preventing larger pieces of unprocessed asphalt based material as well as foreign objects such as sticks, wood, stones, nails and other large particulates from passing through, as will be described in greater detail below.

The preferred embodiment of the asphalt based material recycling system and method according to the present invention preferably includes a second milling apparatus 22 as well as a second filter 24, for providing a second stage of heated milling step 118 and filtering step 120.

Figure 3:
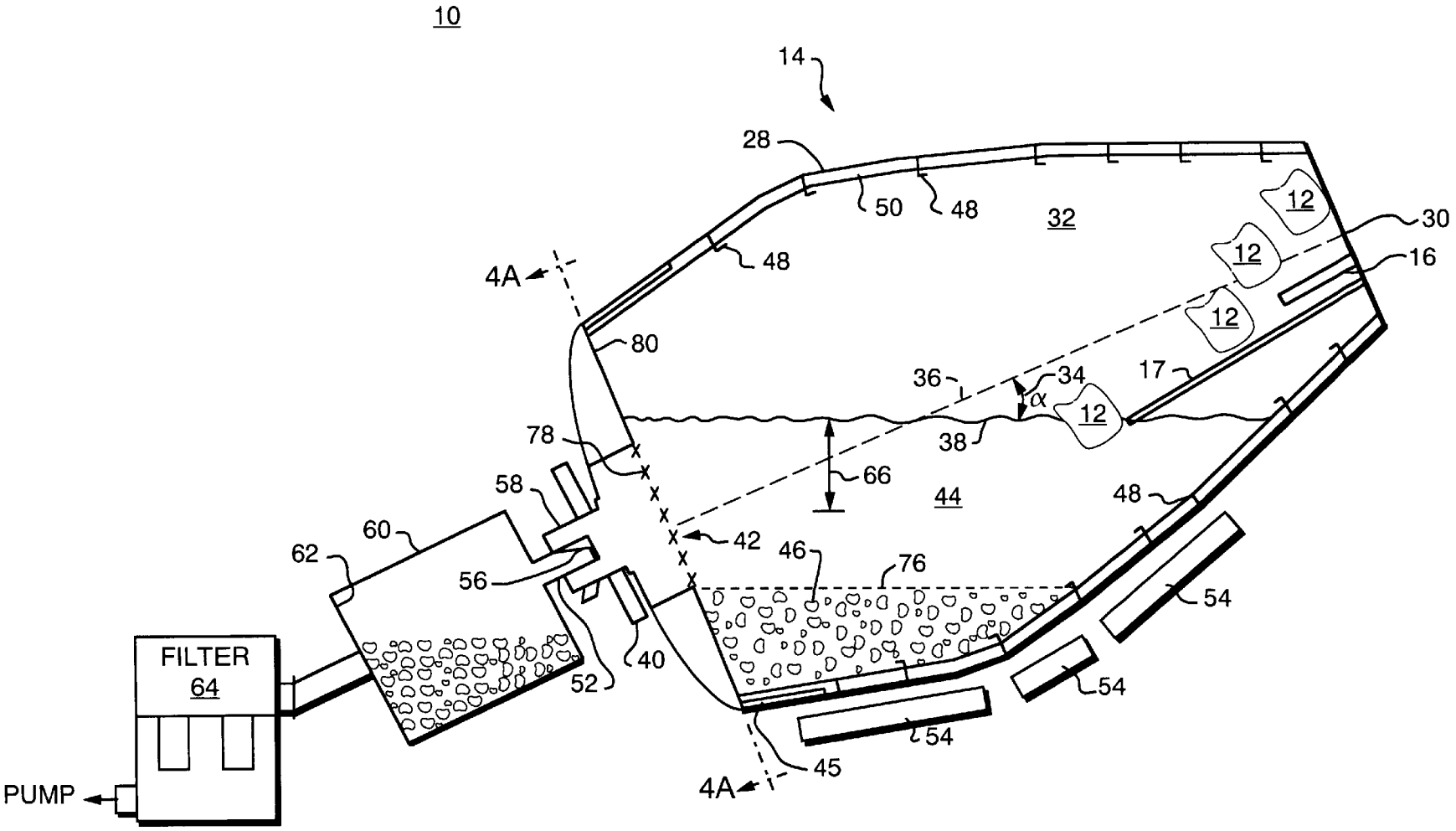
FIG. 3 is a side cross-sectional view of a heated milling apparatus according to the preferred embodiment of the present invention.

One embodiment of the heated milling apparatus 22, FIG. 3, includes a rotatable milling vessel 28 having at least one generally large opening 30 and an interior heated milling region 32 that receives asphalt based material 12 to be recycled. The opening 30 is preferably left open to continuously vent the interior milling region 24 of the rotatable milling vessel 28, allowing moisture to be removed while heating and milling the asphalt based material 12. The opening 30 is preferably large enough (approximately 3 feet in diameter) to allow a conveyor or other similar device to convey and deliver the asphalt based material 12 to be recycled having larger odd shapes (such as the case for example with used roofing shingles) through the opening 30 and into the internal milling region 32 without having to first shred or otherwise reduce the size of the asphalt based material to be recycled 12.

The milling vessel 28 preferably has an axis of rotation 36 disposed at an acute angle 34 with respect to the horizontal plane such as formed, for example, by the liquid level 38 within the milling vessel 28. The acute angle is preferably in the range of 5° to 45°.

The rotatable milling vessel 28 is rotated at the acute angle 34 with respect to the horizontal plane with a rotation mechanism 40, including, for example, a motor and gear mechanism, bearing and support (not shown for the sake of clarity) coupled to the rotatable milling vessel 28. The opening 30 of the rotatable milling vessel 28 is thereby elevated with respect to the outflow region 42 of the rotatable milling vessel 28 so that asphalt based material mixture being recycled (slurry) 44 moves from the opening 30 towards the interior milling region 32, allowing the opening 30 to continuously vent the milling vessel 28 and for providing a liquid head as will be explained further below.

The heated milling apparatus 28 further includes a plurality of milling elements 46, such as balls or other similar but perhaps differently shaped elements made of steel or another suitable metal or non-metal, disposed in the interior milling region 32. As the rotatable milling vessel 28 rotates, the milling elements 46 move throughout the rotatable milling vessel 28, grinding, crushing and abrading the asphalt based material to be recycled 12, to reduce the size of the asphalt material.

One example of the milling elements 46 includes steel balls ranging in size from 1 to 1 ½ inches and filling approximately ¼ to ⅓ of the rotatable milling vessel 28. The present invention contemplates other types of milling elements of various sizes and materials. The level of the milling elements 46 has also been found to be important. If the level 76 of the milling elements 46 is kept below the grate 78 found in front of the outflow region 42, nails and other debris can be easily removed and the outward flow of material will be maximized.

The preferred embodiment of the rotatable milling vessel 28 further includes a plurality of mixing members 48 mounted on an interior surface 50 of the rotatable milling vessel 28, such as rods or "paddles" which may be triangular or "L" shaped (48*a*–48*c*, FIG. 4B), approximately ¾ inches by 2 inches, made of hardened steel or similar material, and which are welded or otherwise attached to the interior surface 50 and extend into the interior milling region 32 of the rotatable milling vessel 28. The mixing members 48 are preferably arranged in a pattern on the interior surface 50 of the rotatable milling vessel 28 and serve to pull the asphalt based material 12 away from the opening 30, towards the interior milling region 32, and down into the slurry 44. The mixing members 48 also serve to pick-up milling elements 46 as the rotatable milling vessel 28 rotates, causing the milling elements 46 to fall back down into the slurry 44 further greatly enhancing the milling effect of the milling vessel 28.

On example of the milling vessel 28 has a volume of about 10 cubic yards and rotates at a speed of about 20 RPM allowing milling and filling of the vessel 28 to occur simultaneously and either continuously (with material constantly flowing in and out) or in a "batch" mode (with material to be processed flowing in, preferably after being weighed; all material processed; and then processed material flowing out). Although the vessel of the present invention is shown in the shape of a cement truck type of vessel, this is not a limitation of the present invention as a round, "egg", pipe or other shaped vessel 28 will also prove satisfactory and are considered to be within the scope of the present invention.

The shape, angle (tilt) and design of the rotatable milling vessel 28 of the present invention are unique and are critical design parameters. The present invention allows material to move in and out of the rotatable milling vessel 28 continuously and within a narrow range of parameters of volume and viscosity. Moreover, the present invention allows the recycled material 44 to be made "coarser" or "finer" while still maintaining the output at a relatively constant level. This is accomplished by having a generally large grinding reservoir which could also be accomplished using a round or egg shaped rotatable milling vessel 28. In addition, keeping the bottom of the input region higher than the output opening aids in accomplishing one of the goals of the present invention namely, providing a liquid head.

The angle or tilt of the rotatable milling vessel 28 allows for a wide opening 30 into which can be feed the material to be recycled 12 along with an angular throat or baffle 17 and forces the material to be recycled 12 down into the liquid slurry 44. These features are important because since the material to be recycled (typically roofing shingle scraps) is irregular in shape, introducing these irregularly shaped pieces 12 into the rotatable milling vessel 28 simultaneously with or followed by a predetermined flow of hot asphalt from the source of hot asphalt 16 insures that all of the material to be recycled 12 slides down into the grinding reservoir 44.

In accordance with one feature of the present invention, the grinding reservoir 44 is large because of the rounded shape of the bottom of the rotatable milling vessel of the bottom region 45 of the rotatable milling vessel 28. If the shape were a cylinder, the grinding reservoir would be much smaller.

Once the material to be recycled 12 is in the grinding reservoir 44, the mixing members 48 serve to pull the larger pieces beneath the surface of the liquid reservoir 44 and into the milling elements 46. While in the grinding reservoir 44, the viscosity of the slurry causes unground pieces of material to be recycled 12 to stick to the wall of the milling vessel 28 as it rotates. This promotes grinding and mixing because mostly unground material sticks to the wall of the milling vessel 28 and is constantly reintroduced into the mix or slurry 44 and drawn beneath the milling elements 46. If this did not occur, the materials to be recycled 12 would tend to float and not grind as efficiently.

The shape of the milling vessel 28 also creates a current that pulls the wetted asphalt based material to be recycled 12 into the grinding reservoir 44. This occurs because the slope of the milling vessel 28 is shallow in the area of opening 30, because the processed material continuously flows out of the vessel, and because the lowest point on the input side is higher than the output. The liquid mixture or slurry 44 in the milling vessel 28 is thick and sticky and tends to roll with the revolutions of the milling vessel 28 particularly in the area of the slurry 44 that is close to the wall of the milling vessel 28.

In the deeper areas of the slurry mixture, approaching the outlet area 42, the slurry in this area (the "grinding" area or reservoir) is also affected in such a way that facilitates mixing of the slurry 44 with the asphalt based material to be recycled 12. More particularly, the mixing elements 48 raise the scrap material and the milling elements or balls 46 and drop the balls into the slurry 44 to promote grinding. This effect not only promotes grinding but also creates currents in the slurry 44 that greatly improves mixing, as well as wetting and softening of the asphalt based material 12 to be recycled.

The tilt of the milling vessel 28 also allows the time that the material to be recycled 12 is in the mill to be controlled. In prior art ball mills, the amount placed into the mill determines the output rate and grind size. Material goes in and out at the same rate. Only the grind size can vary. As the amount of input material increases, the output increases by the same amount while the grind size increases. This is because the input area is at the same level as the output area and therefore, what goes out must be the same as what comes in.

In the present invention, the output of the mill is a function of the material input, the opening of the valve 56 controlling the output, the viscosity of the material, and the liquid head. The liquid head is represented by arrow 66 and is the measure of the extent of the liquid slurry 44 which extends above the horizontal output level of the orifice and valve 52. This is critical because increasing or decreasing the liquid head 66 makes the particle size distribution coarser or finer, while maintaining a constant output volume.

In the present invention, the level of the liquid slurry 44 can vary above or below the horizontal level of the orifice and valve 52, while the liquid slurry 44 still discharges from the milling vessel 28. The liquid head 66 is maintained due to the size of the input region 30 (2' to 3' or more) versus the output orifice 52 (approximately 4") Indeed, by varying the liquid head 66, the grind time can be shortened or lengthened while keeping the output rate relatively constant. Increasing the liquid head increases the grind time and thus reduces the grind size, all without materially changing the output rate. Prior art ball mills have no liquid head and no such control over a liquid head and therefore, the grind size is a function of the input volume only, which affect output volume. To reduce the grind or particle size in prior art ball mills, both the input and output rate must be reduced. In the present invention, only the liquid head needs to changed.

Having a liquid head 66 also increases the grinding efficiency, without having to increase the amount of milling elements or balls 46 or the size of the milling vessel 28. Pressure increases with an increased liquid head due to the volume and weight of the liquid 44. This pressure exerts forces on the milling elements 46 which adds significantly to their crushing power. The liquid head pressure also adds another process control feature to the present invention. The higher the head pressure, the faster the flow is out of the output orifice and valve 52. Prior art continuous ball mills could not increase or decrease the flow by varying the liquid head pressure because the liquid flows out at the level of the discharge orifice and the liquid cannot be contained above the discharge orifice since the discharge orifice and the input region are at the same level.

The large volume of the liquid slurry 44 also has another important aspect in the present invention namely, the volume of liquid 44 acts as a heat sink and stabilizes the temperature and thus the viscosity of the liquid slurry 44, keeping the output relatively constant. This is an important feature because the output and grind time need to be stable despite variability in the moisture content of the asphalt based material to be recycled 12. Additionally, the downstream filtering process is also highly viscosity dependent. If the viscosity is to high, the rotary filter 58 will over-reject the material, and if the viscosity is to low, the second stationary filter 64 will over-reject material.

The liquid head 66 is also important because the grinding effect is facilitated by softening and liquefying the asphalt based material to be recycled 12. The liquid head 66 must be changed if the asphalt based material to be recycled 12 is wet, cold, or contains more or less asphalt. As stated previously, in the present invention, the output rate and the input rate can vary independently of one another. This is significant because the preferred method of adding asphalt based material to be recycled is in batch form, due to the fact that the asphalt based material 12 is typically very irregular and a weight belt must be used to control the amount by weight. A weight belt cannot be used continuously because the feed of the asphalt based material to be recycled 12 is so irregular.

The viscosity of the slurry 44 is determined by the amount of asphalt added at 16, the amount of virgin or other processing element added at 16, the type, quality and condition of the asphalt based material being recycled, and the temperature of the slurry 44 in the rotatable milling vessel 28. For example, the amount of surface granules and asphalt condition and content varies greatly with asphalt material being recycled. It is always more desirable to keep the viscosity relatively constant. Therefore, to keep a constant liquid head 66 and grind consistency, the orifice plug 56 can be opened or closed in between batches or to compensate for wet, cold, high granular content or asphalt deficient material to be recycled 12. The large liquid head and indeed the large volume of liquid slurry 44 also tends to reduce the variability of the process because asphalt based material 12 varies in age and composition so the large volume reservoir of liquid slurry 44 tends to average out the ingredient mix.

The unique design and arrangement of the heated milling apparatus 22 allows the system to be operated either in batch or continuous mode. If a finer grind is needed or if asphalt based material 12 is very wet or cold, the orifice valve plug 56 may be closed and the milling apparatus 22 can be run in a batch mode until the grind and viscosity of the slurry are correct. The material to be recycled 12 can be batched in or fed continuously and may be batched out or continuously flow out. In the preferred embodiment, the material to be recycled 12 is input in batch mode but flows out continuously, which is yet another novel feature of the present invention.

Figure 5:
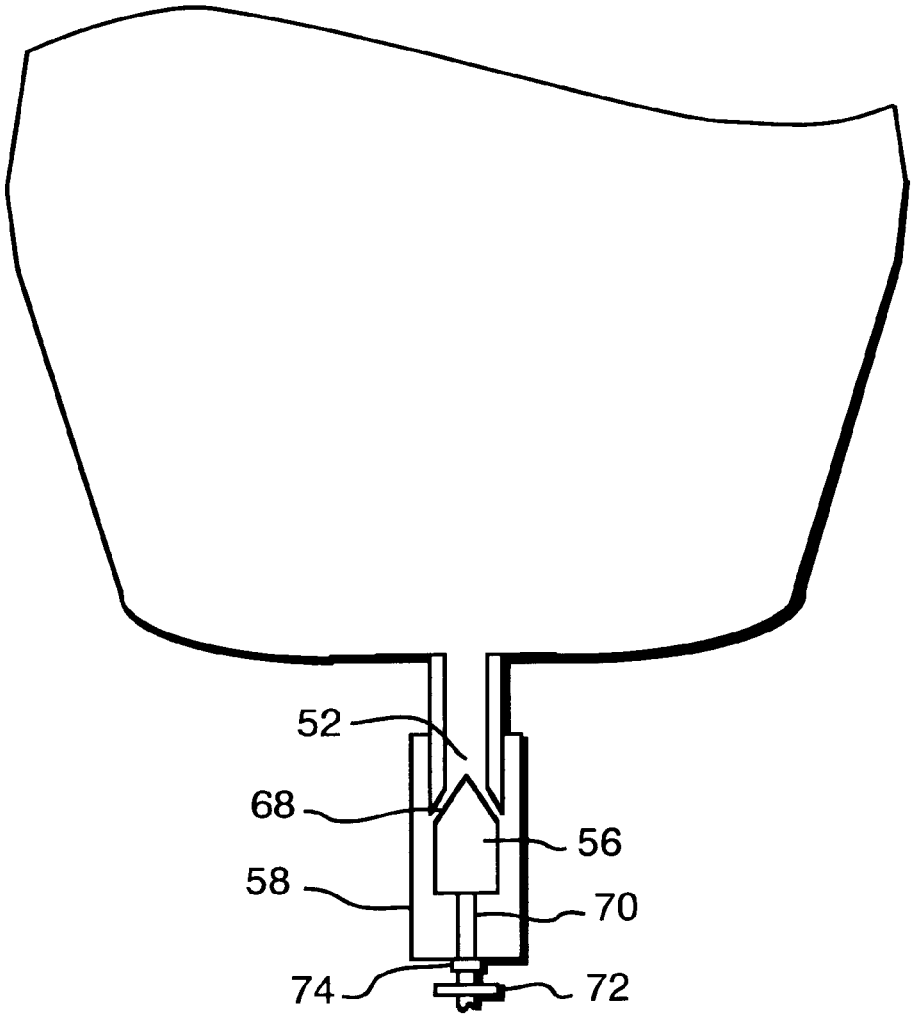
FIG. 5 is a top cross-sectional view of a schematic diagram of the milling vessel orifice valve used with the asphalt material recycling system and method according to one embodiment of the present invention.

It is believed that the design of the plug valve 56, FIG. 5 which fits in to orifice 52 is critical. The present design which utilizes a plug valve 56 having a triangular shaped head region 68 allows the valve 56 to rotate without opening and closing devices creating a larger radius, and is the only type of valve that does not cause a restriction of flow inside the orifice pipe 52. It has been found that any type of restriction in the orifice 52 will cause nails and other debris to build up and cause a blockage in the orifice 52. In the present invention, the plug valve 56 and orifice 52 rotate with the rotatable milling vessel 28 and rotary filter 58. The plug valve 56 is coupled by means of a rod 70, such as a threaded rod, to adjusting wheel 72. Turning adjusting wheel 72 through a threading region 74 in the rotatable filter area 58 causes the plug valve 56 move into and out of the orifice 52, thereby affecting the flow of material 48 into and out of the rotatable milling vessel 28.

Figure 4A:
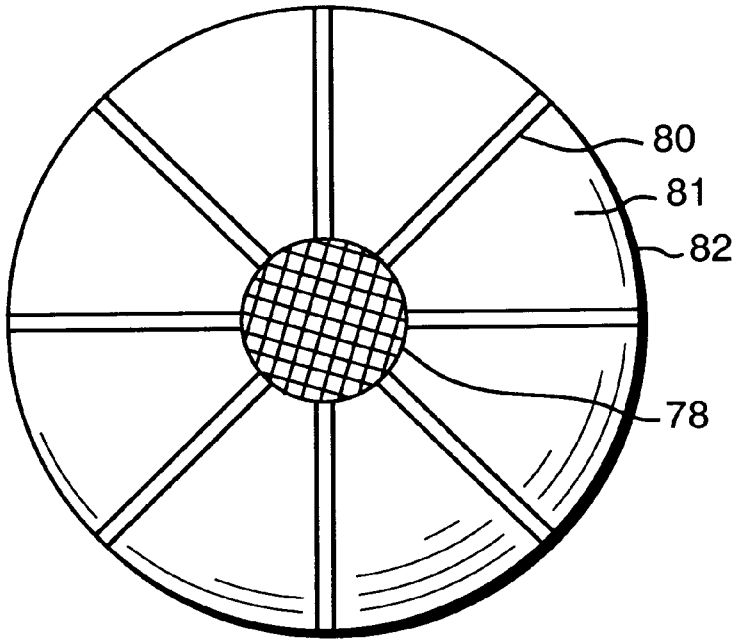
FIG. 4A is a front view of a schematic diagram of the raised lifter members disposed on the back plate of at least one milling vessel used with the asphalt recycling system and method according to one embodiment of the present invention.
Figure 4B:
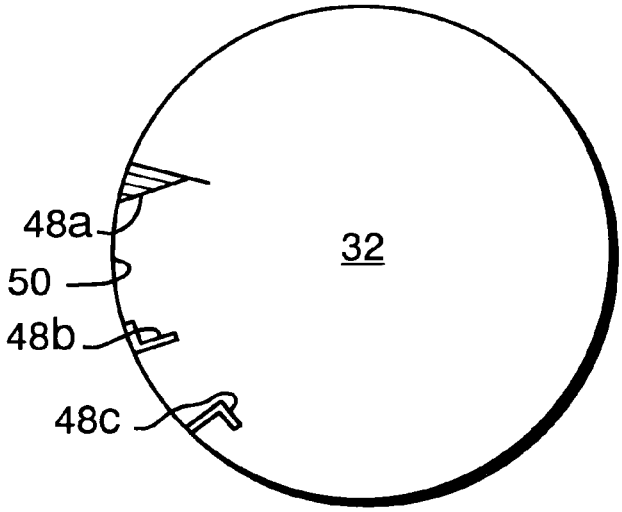
FIG. 4B is a cross-sectional schematic representation of a milling vessel showing two embodiments of asphalt material mixing members according to one feature of the system and method of the present invention.

FIG. 4A depicts the grate 78 and the lifters 80 disposed on the back wall of the rotatable milling vessel 28 proximate the discharge area of the rotatable milling vessel. It is very desirable to remove nails, rocks, and other heavy debris from the slurry 44 because the final product will be adversely affected and nails and rocks are difficult if not impossible to pump. The present design of the back plate of the rotatable milling vessel 28 is critical. The center of the back of the rotatable milling vessel contains a grate 78. For maximum efficiency, the grate is sized to extend to the level 76, FIG. 1 of the milling elements 46, or just above. As previously explained the milling elements 46 should be lower than the outlet orifice 52. In the preferred embodiment, the grate 78 is centered over the center line of the orifice and is a three quarter inch mesh (in the preferred embodiment where the milling elements 46 are approximately one and three quarter inches in diameter). The grate 78 is approximately twelve inches in diameter. The slope of the back plate 80, FIG. 1 should be slightly obtuse relative to the horizontal liquid level 38.

The back plate also contains lifters 80. In the preferred embodiment, the lifters are approximately three quarters of an inch wide and two inches high and extend radially from the edge of the grate 78 to the outside diameter 82 of the rotatable milling vessel 28. The lifters 80 may be in the form of rectangular elements or maybe "L" shaped. Any other suitable shape is also contemplated by the present invention. The design of the lifters 80 causes the back plate 81 to act as a "pump". This allows the rotatable milling vessel 28 to pump liquid slurry out 44 even if the liquid level 38 is below the output orifice 52. This feature is important because in some instances, the specifications for the liquid slurry call for a coarse grind. As previously noted, reducing the liquid head 66 with all other parameters equal will also reduce pressure on the milling elements 46, shorten the grind time, and coarsen the grind.

As the back plate 81 rotates through the liquid slurry 44, the lifters 80 pick up asphalt, nails, rocks and other debris that would otherwise stay in the milling elements. When the rotatable mill 28 rotates, the section of the back plate 81 beneath the level 38 of the slurry 44 lifts or carries the liquid slurry 44 and debris out of the milling elements 46 and allow it to constantly flow down along the back plate, parallel to the lifters 80 thereby allowing for a constant flow of liquid slurry 48 down and through the grate 78. This feature is also important when the rotatable milling vessel 28 needs to be emptied for an inspection and/or maintenance. The balls or milling elements 46 can also be emptied using the lifting. The standard rotatable milling vessels typically have a vertical wall design. This will not remove nails because they would not be picked up efficiently and therefore the debris would drop back into the mill, clogging the mill and negatively interfering with the grinding process.

Accordingly, the present design very efficiently rids the mill of nails and other debris. The lifters 80 also serve to substantially slow the wear of the back plate 81 by interrupting the slide pattern of milling elements 46. The back plate 81 wears at a much faster rate than the rest of the rotatable milling vessel 28 because the rotation of the milling elements 46 is influenced both by the back plate 81 and the shape of the bottom region of the milling vessel 28. This causes sliding and counter-rotation of the milling elements 46 which creates wear on the back plate.

Figure 6:
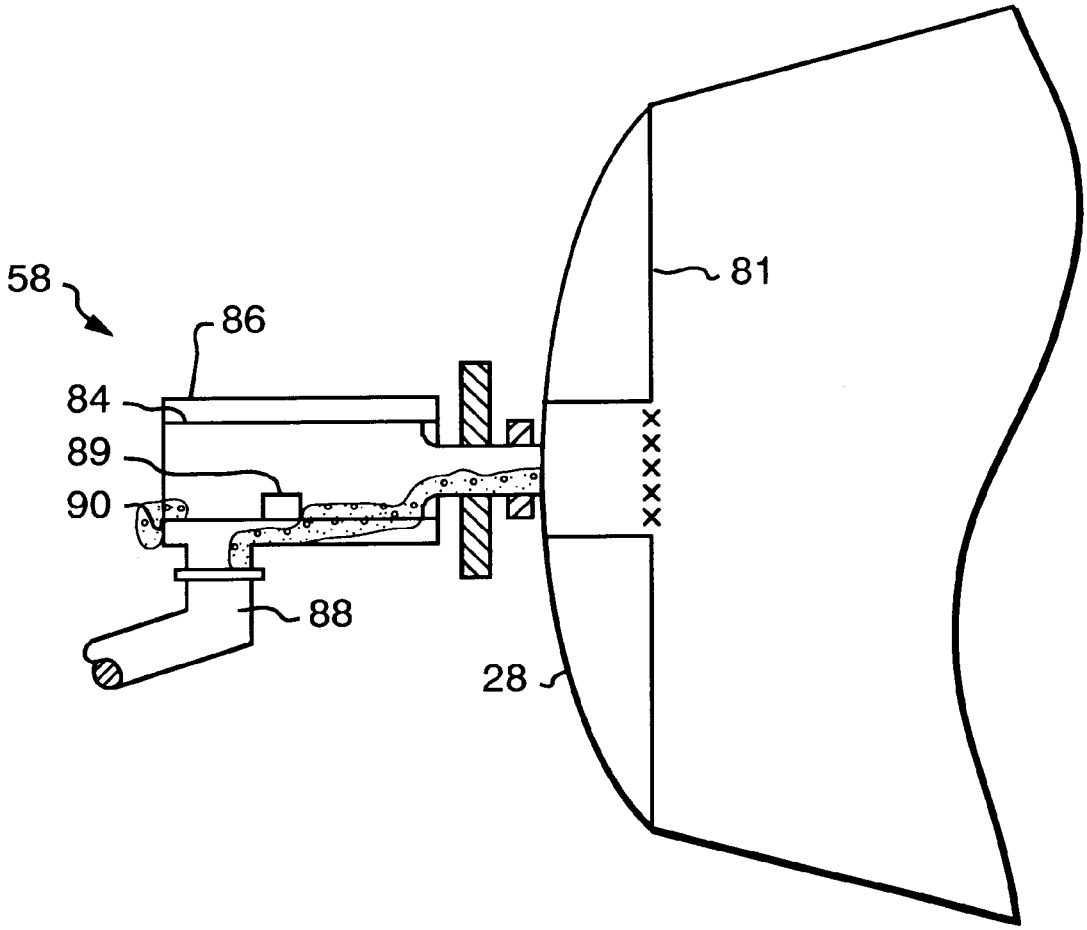
FIG. 6 is a schematic cross-sectional view of one embodiment of a first recycled asphalt based material filter coupled to the outflow of the first milling vessel according to one embodiment of the present invention.

Immediately after the slurry material 44 leaves the rotatable milling vessel 28, it passes through a rotary screen 58, FIG. 6. The rotary screen 58 includes a wire mesh cylinder screen 84 with one quarter inch openings or holes that rotates by virtue of its attachment to the rotatable milling vessel 28. The screen is housed in a heated cylinder 86 that does not rotate. The accepted material passes through the screen 84 and flows to the secondary mill, in the preferred embodiment, through conduit 88. Rejected material such as nails, rocks, and other debris 90, tumbles out of the front of the screen and is collected. Alternatively, a small "dam" 89 or other similar blocking element may be present on the screen 84 to force the recycled material down into the conduit 88 upon contacting the "dam", while nails, sticks, rocks or other debris 90 would tumble over the "dam" 89 and be discharged.

As previously mentioned, after passing through the rotary screen 58, the asphaltic slurry mixture 44 flows into a secondary mill 60, FIG. 1 where any unground material is processed. This second rotatable mill 60 uses the same principals as the first rotatable milling vessel 28 except that the second rotatable milling vessel 60 is shaped like a cylinder because a large liquid head is not require. The secondary rotatable milling vessel 60 is also tilted at an angle and the back wall is also at an angle to act as a pump. After final processing in the second rotatable milling vessel 60, the liquid slurry material 44 flows into the final filter 64.

The rotatable milling vessel 28 also preferably includes an outlet or discharge area orifice and valve 52 that allows the recycled asphalt based material slurry 44 to be discharged from the rotatable milling vessel 28.

The rotatable milling vessel 28 further includes an asphalt based material additive pipe or similar device or region 16, for introducing an asphalt based material additive, of the type described above, into the interior region 32 of the milling vessel 28 during the recycling process. Introducing a generally continuous flow of heated asphalt additive 16 along with the asphalt based material to be recycled 12 insures that the asphalt based material to be recycled slides down into the interior 32 of the milling vessel 28 in addition to serving to "rejuvenate" the asphalt based material being recycled.

In the preferred embodiment, a 15 to 50 percent addition rate of asphalt by weight is preferred at a temperature of between 250° to 350° to maintain a viscosity of between 2000 and 10000 centipoise with a range of 2000 to 7000 centipoise considered more desirable. The viscosity is critical because since the slurry is approximately 50% ground suspended solids, the liquid slurry material 44 cannot be pumped, if the viscosity is too high, and the suspended solids will not flow over the weir of the filter if the viscosity is too low, as will be described in connection with one embodiment of a filter below.

The heated milling apparatus 22 further includes one or more heat sources 54, such as an external gas fired flame heater, electric or gas fired infrared heater, hot oil jacket, or other similar and/or suitable heat source disposed proximate the rotatable milling vessel 28 to provide heat to the rotatable milling vessel 28.

The preferred embodiment of a storage apparatus 18, FIG. 1, if provided, is described in co-pending related U.S. patent application Ser. No. 08/756,881 filed Dec. 2, 1996 and fully incorporated herein by reference, and includes a rotatable storage vessel similar to the rotatable milling vessel 28 described above. The rotatable storage vessel includes an opening and interior storage region that receives the reduced asphalt material slurry 44 from the heated milling apparatus 22. The recycled asphalt material slurry 44 is transferred from the milling apparatus 22 to the storage apparatus 18, for example, by pumping the material or gravity feeding the material by elevating the milling apparatus 22 with respect to the storage apparatus 18. The opening preferably remains open to provide continuous venting of the interior storage region of the storage vessel 18. Alternatively, an agitated, heated vessel can be used as storage vessel.

The storage apparatus 18 also includes one or more heat sources, such as an external flame or hot oil circulating around the rotatable storage vessel in a jacket. Heating of the rotatable storage vessel 18 during storage facilitates mixing of the reduced asphalt material and maintains the desired consistency of the reduced asphalt material for later use, for example, to be applied as a coating in a production process. The storage apparatus 18 also includes an outlet or discharge valve that allows the recycled asphalt material slurry 44 to be discharged from the rotatable storage vessel 18.

The milling apparatus 22 further includes a rotating plug valve 56, disposed within orifice 52, to allow the orifice 52 to be partially opened or closed, to clean limit flow, operate is a batch process or otherwise service the heated rotating vessel 28. The plug valve 56 will be explained in greater detail below in connection with FIG. 5. Located around the periphery of orifice 52 is a rotary filter 58 which, in the preferred embodiment, serves as the first filter in a series of two filtering devices to filter the outflow of recycled material 44. Rotary filter 58 will also be explained in greater detail below.

The preferred embodiment of the asphalt based material recycling system 10 according to the present invention preferably includes a second heated and rotatable milling apparatus 60. A second heated and rotatable milling apparatus 60 serves to further grind or process any unground asphalt based material 12 remaining in the recycled slurry 44 to below 250 mesh to facilitate operation of the filter. Only finely ground solids will stay in suspension and travel over the wier.

The second apparatus 60 is, much like the first heated milling apparatus 22, disposed at an angle as against a horizontal plane. However, the second milling apparatus 60 may be shaped like a cylinder because a large liquid head is not required, although this is not a limitation of the present invention as the second milling apparatus 60 may have the same shape as the first heated milling apparatus 22. In addition, the back wall 62 of the second heated milling apparatus 60 also includes recycled material movement devices as described in connection with the first heated milling apparatus 22, to act as a pump to pick up and direct the recycled material slurry out of the second heated milling vessel 60 to a second filter apparatus 64, which will be explained in greater detail below.

Figure 7:
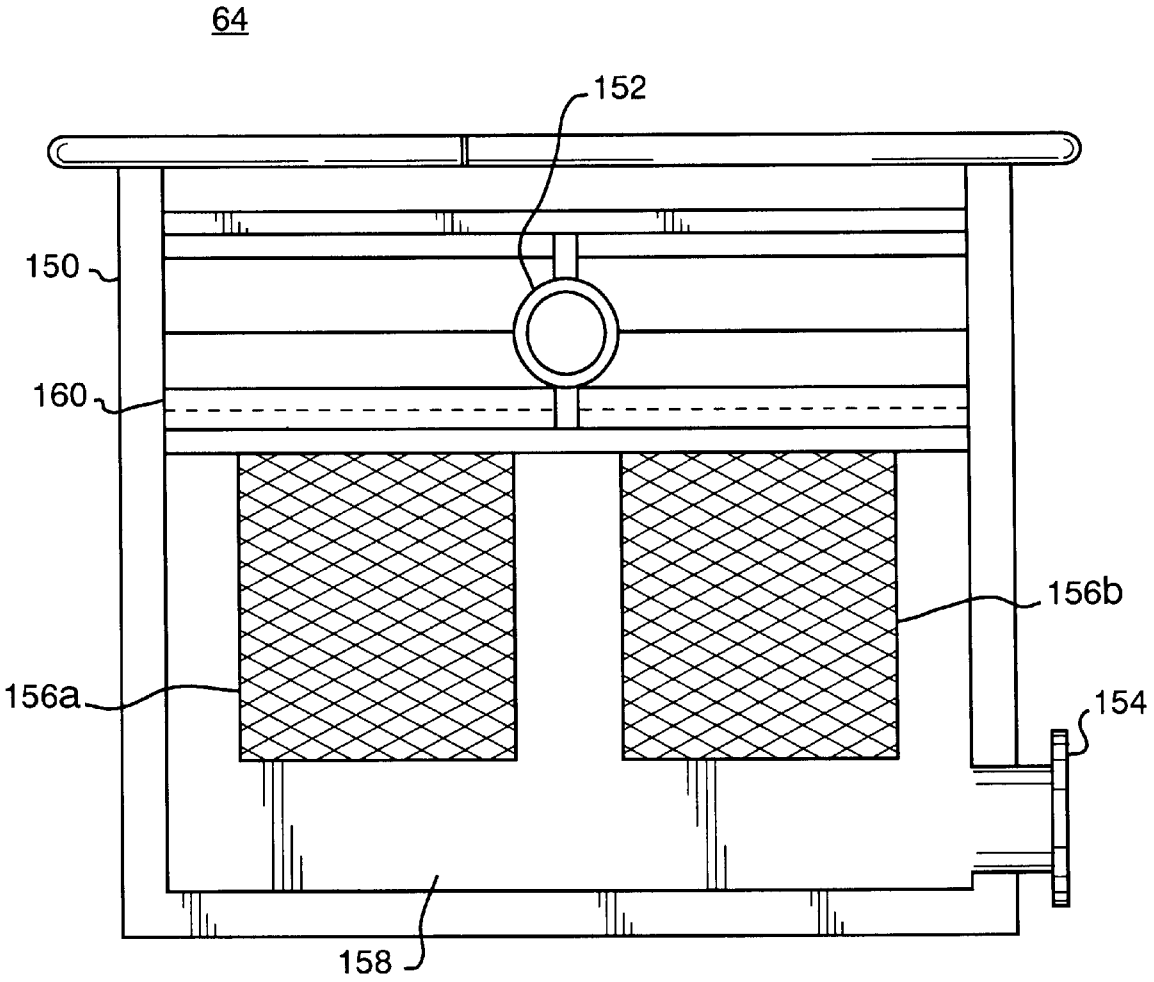
FIG. 7 is a schematic cross-sectional view of a second asphalt based material filter according to one embodiment of the present invention.

The preferred embodiment of a filtering apparatus 64, FIG. 7, includes a filter housing 150 having an inlet 152, for receiving recycled asphalt based material slurry 44 from a storage apparatus or directly from a heated primary or secondary milling apparatus, and an outlet 154, for discharging filtered reduced asphalt material 44. The filter 64 is designed to filter out and separate out nails, rocks, metals and other debris normally found in scrap asphalt based material to be recycled such as scrap roofing shingles.

The filter apparatus 64 is approximately 36 inches high and approximately 24 inches in diameter, and includes one or more filter members or baskets 156*a*–156*b* disposed or mounted within the filter housing 150, for allowing reduced asphalt material to pass through while preventing larger material and foreign objects, such as nails, metal material, and other debris from passing through.

The filter baskets 156*a*–156*b* include one or more apertures that are dimensioned and sized, e.g., about 1/16 to 1/8 inches, to prevent the foreign objects or undesirable debris from passing through the filter baskets 156*a*–156*b*. The perforations or apertures can have various sizes or dimensions to provide various degrees of filtering from course filtering to fine filtering.

Recycled slurry material 44 enters filter 64 through inlet 152 and passes through a weir system, flows into a lower collection point or region 158 to outlet 154 to be pumped to a storage system or to a plant to be reused. After the slurry material 44 flows into the top of the filter through inlet 152, it is diverted either left or right into one of the wire mesh baskets 156A–156B. Each wire mesh basket 156A–156B is removable. The wire mesh baskets 156A–156B catch nails, rocks and other heavy materials that sink. Initially, most of the liquid slurry material 44 passes through the baskets 156A–156B.

Figure 8:
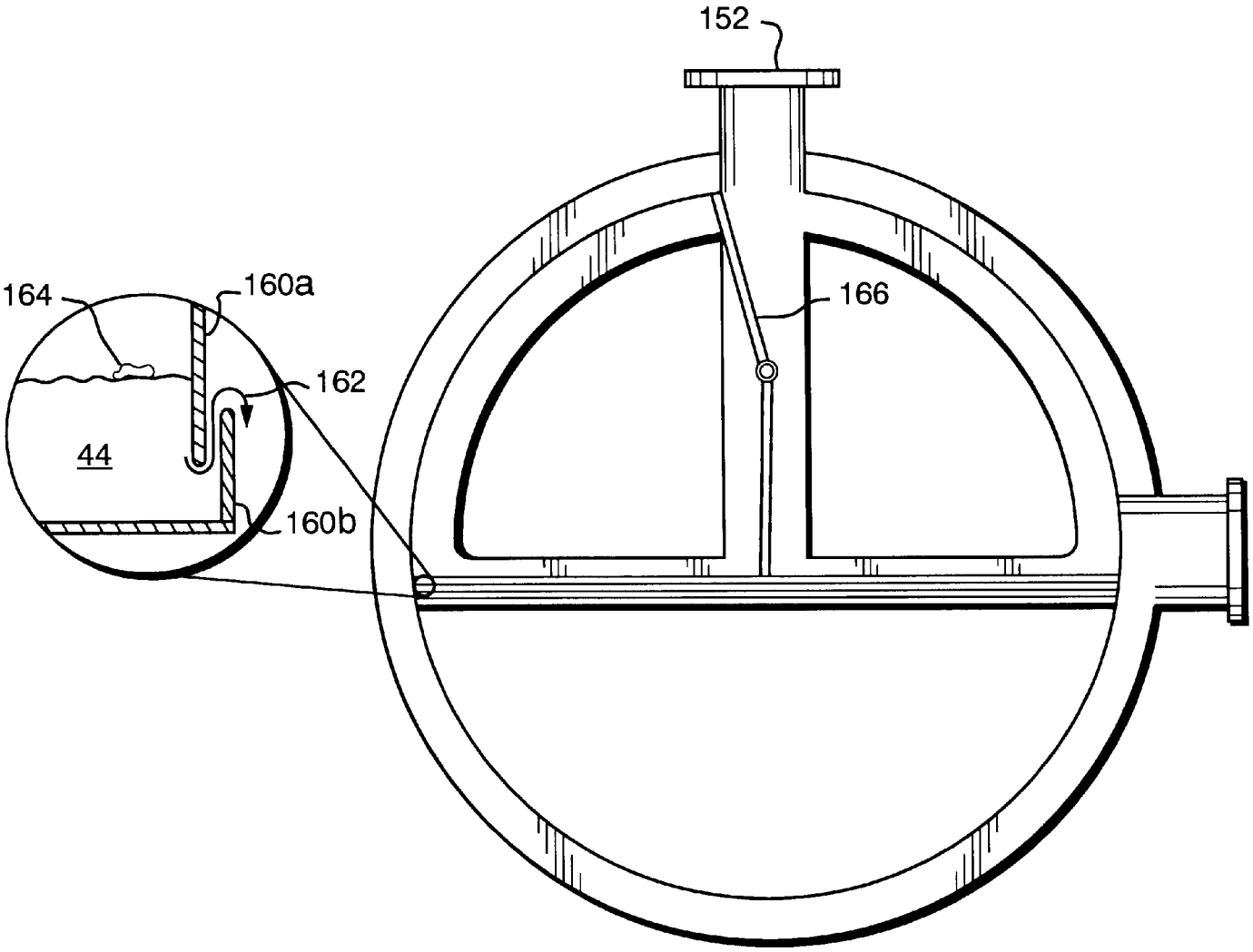
FIG. 8 is a top view of a schematic view of the second asphalt based material filter of FIG. 7 according to one embodiment of the present invention side.

However, the baskets 156A–156B are not designed to remain completely open/draining. The baskets 156A–156B operate with a small amount of drainage just so they can be removed with as little liquid as possible. They can be removed for cleaning, with as little liquid as possible remaining in them. The slurry material 44 fills the baskets with the nails and other heavy materials which sink to be bottom of the baskets 156A–156B. Since the liquid slurry material 44 does not drain as quickly as it flows in from the inlet 152, the slurry material passes over the basket to a weir system 160. The weir system 160 is designed to separate out any floating debris that would pass over the baskets 156A–156B such as wood. The slurry material 44 flows beneath the primary weir 160A, FIG. 8 and over the secondary weir 160B as shown by arrow 162 which depicts the flow of the slurry material 44. Any floating debris 164 is collected behind the primary weir 160A. The increase in the size of the flow from the inlet pipe (3") to the filter (12") allows the heavy unground materials to drop out of the solution by slowing velocity of the flow.

When one of the baskets 156A–156B is filled, the pivot baffle 166 is moved and the flow of the slurry material 44 from inlet 152 is directed to the other basket 156A–156B. At this point, the first basket is removed and cleaned. The duo basket arrangement makes it possible to operate the filter 64 efficiently and continuously. The filter 64 may also include a level monitor which can be utilized to turn a pump on and off, as needed to pump the slurry material 44 from this filter apparatus 64.

The grinding process in the first and/or second milling apparatus 14–22 must be closely controlled for the filter 64 to function properly. It has been found that the viscosity of the liquid slurry material 44 should be in the range of 2000–7000 centipoise to allow the filter 64 to function optimally. The viscosity of the slurry material 44 is controlled by the amount of asphalt or other processing agent that is added as well as the grinding time and grinding temperature.

The filter apparatus 24 preferably includes a filter heat source such as hot oil or other liquids, maintained in contact with the filter housing 150 by means of a jacket surrounding the filter housing 150 as well known in the art. The heating of the filter housing 150 maintains the desired consistency of the reduced asphalt material to facilitate the flow and filtering of the asphalt material slurry 44.

Accordingly, the combination of heating and milling the asphalt based material to be recycled as disclosed by the present invention allows asphalt based material, including granules, to be reduced to a fine mesh that is capable of being mixed in an asphalt solution and to be reused in asphalt roofing, asphalt based cements and coatings or other products such as asphalt paving compositions, and other applications. The removal of moisture in the asphalt roofing material, such as by continuously venting the heated milling apparatus allows the asphalt based material to be recycled to be simultaneously milled and heated in the heated milling apparatus without causing a dangerous pressure build up. The asphalt material recycling system and method of the present invention also provides a relatively simple and efficient way of recycling asphalt based roofing materials and avoids the expense of complex asphalt recycling systems.

Modifications and substitutions by one of ordinary skill in the art are considered to be within the scope of the present invention which is not to be limited except by the claims which follow.

What is claimed is:

1. An asphalt based material recycling system comprising:

a heated milling apparatus, for receiving asphalt based material to be recycled and for simultaneously heating and milling said asphalt material, said heated milling apparatus including:

at least a first rotatable milling vessel having an opening, an outlet, and an interior milling region, said opening for receiving said asphalt based material to be recycled, said at least a first rotatable milling vessel opening communicating with said interior milling region, for allowing said asphalt based material to be recycled to be inserted into said interior milling region of said at least a first rotatable milling vessel through said opening, and for simultaneously continuously venting said interior milling region allowing escape of moisture from said asphalt material during heating and milling of said asphalt material, said at least a first rotatable milling vessel having an axis of rotation disposed at an acute angle with respect to a horizontal plane, and whereby said at least a first rotatable milling vessel is rotated at said acute angle with respect to said horizontal plane;

a plurality of milling elements disposed within said rotatable milling vessel, for milling said asphalt based material to be recycled as said rotatable milling vessel rotates;

said heated milling apparatus including a plurality of mixing members mounted proximate an interior surface of said rotatable milling vessel, for moving and mixing said asphalt material with said milling elements;

a milling vessel heat source, for heating said rotatable milling vessel as said rotatable milling vessel rotates and said asphalt material is milled;

a source of asphalt based material processing additive, for introducing a processing additive into said interior milling region of said at least a first rotatable milling vessel, said processing additive mixing with said heated and milled asphalt based material to be recycled, for forming a recycled asphalt based material slurry; and at least one filtering apparatus, for filtering said recycled asphalt based material slurry, for removing at least foreign objects from said reduced asphalt material.

2. The asphalt based material recycling system of claim 1 wherein said at least a rotatable milling vessel includes a back plate having an outlet for dispensing said recycled asphalt based material slurry, said outlet disposed at a level below a bottom region of said vessel opening, said back plate arranged at an obtuse angle relative to said horizontal plane, and further including asphalt based material slurry lifting members, for lifting said recycled asphalt based material slurry and for providing said recycled asphalt based material slurry to said back plate outlet region.

3. The asphalt based material recycling system of claim 2, wherein said back plate further includes a screen covering said outlet region of said back plate.

4. The asphalt based material recycling system of claim 1, wherein said milling elements include steel balls.

5. The asphalt based material recycling system of claim 1, wherein said processing additive includes virgin flux asphalt.

6. The asphalt based material recycling system of claim 1, wherein said processing additive is selected from the group consisting of virgin asphalt, resin, solvent, oil and plastic.

7. The asphalt based material recycling system of claim 1, wherein said at least one filtering apparatus includes a rotating filter coupled to at least a first rotatable milling vessel.

8. The asphalt based material recycling system of claim 7, wherein said rotating filter includes a foreign object outlet region, for allowing foreign objects to be expelled from said rotating filter.

9. The asphalt based material recycling system of claim 1 further including a second rotatable milling vessel, for receiving said recycled based asphalt material slurry from said at least one filtering apparatus.

10. The asphalt based material recycling system of claim 9, further including a second filtering apparatus, for receiving recycled asphalt based material slurry from said second rotatable milling vessel.

11. The asphalt based material recycling system of claim 10, wherein said second filtering apparatus includes a filter housing having an inlet, for receiving said recycled asphalt based material slurry from said second rotatable milling vessel, and an outlet, for discharging filtered recycled asphalt based material slurry; and at least one filter member disposed in said filter housing, said at least one filter member having a plurality of apertures, for allowing at least a portion of said received recycled asphalt based material slurry to pass through said filter member, and for preventing at least foreign objects from passing through said filter member.

12. The asphalt based material recycling system of claim 11, wherein said second filtering apparatus includes a filter heat source, for heating said filter housing and said recycled asphalt based material slurry during filtering.

* * * * *